US008567358B2

(12) United States Patent
Willimczik

(10) Patent No.: US 8,567,358 B2
(45) Date of Patent: Oct. 29, 2013

(54) ENVIRONMENTAL FRIENDLY TWO STROKE ENGINE

(76) Inventor: Wolfhart Willimczik, Bradenton, FL (US)

( * ) Notice: Subject to any disclaimer, the term of this patent is extended or adjusted under 35 U.S.C. 154(b) by 439 days.

(21) Appl. No.: 13/012,973

(22) Filed: Jan. 25, 2011

(65) Prior Publication Data

US 2012/0186567 A1 Jul. 26, 2012

(51) Int. Cl.
*F01B 3/00* (2006.01)

(52) U.S. Cl.
USPC ..... 123/45 R; 123/56.1; 123/197.3; 123/61 R; 123/65 P

(58) Field of Classification Search
USPC ..... 123/45 R, 56.1, 45 A, 197.1–197.5, 61 R, 123/66, 72, 65 PE, 65 A, 65 W, 65 P, 193.4, 123/193.6, 193.2
See application file for complete search history.

(56) References Cited

U.S. PATENT DOCUMENTS 1,737,820 A * 12/1929 Ames ..... 123/45 R
4,455,976 A * 6/1984 McCandless ..... 123/197.2
6,758,170 B1 * 7/2004 Walden ..... 123/21

* cited by examiner

*Primary Examiner* — Hung Q Nguyen

(57) ABSTRACT

This is mainly a one-cylinder environmental friendly two stroke engine with a lubrication and a gas control mechanism similar to a four stroke engine. An additional rotation inside of a cylinder of a piston making a stroke motion is utilized for a better gas control mechanism. Control edges on the rotating piston open and close ports in the cylinder in the right sequence, most importantly the exhaust port will be closed prior to the opening of the transfer port. The piston with the rigidly connected L-shaped piston rod rotate around the axis of symmetry of the piston by a rotating spherical bearing rigidly, but eccentrically connected to a rotating shaft. A certain angle between the shaft and the axis of rotation of the piston creates also a stroke motion. An oil-ring around the piston rod works in the same way as by a four stroke engine.

2 Claims, 4 Drawing Sheets

ENVIRONMENTAL FRIENDLY TWO STROKE ENGINE

FIELD OF THE INVENTION

This invention is a one cylinder displacement machine applicable for compressors, air engines, steam engines and predominantly for small two stroke internal combustion engines.

BACKGROUND ART

Today's small two stroke engines need oil in the gasoline. A second disadvantage is that the exhaust port and transfer port are open to the same time.

This invention will remove both disadvantages making the two stroke engine environmental friendly as the four stroke engine. A simple steam engine or air engine without extra valves are also in the scope of this invention.

SUMMARY OF THE INVENTION

The main difference in the construction to usual engines is the fact that the piston makes simultaneously to its stroke motion a rotating motion around its axis of symmetry with one revolution at every stroke motion. This is accomplished by a spherical bearing fixed eccentrically to a shaft, rotating angled around the axis of symmetry of a piston with an L-shaped piston rod ending in an radial directed pin sticking in its bore and forced together with piston and piston rod to move in a slanted ellipse, which has two components of movements: a stroke movement and a rotating movement. A specific angle between both axes creates the stroke motion for the piston. A maximal angle of about 30 degrees seems to be possible for a long stroke length. The L-shaped piston rod is rigidly connected to the piston like at a plunger piston and has on its lower end a very rigidly connected, radial directed pin, that movably fits in the inside bore of the spherical bearing. To the other side, the spherical bearing is rigidly and eccentrically connected to a drive shaft via a disk or a beam. The bearings around the shaft take also the axial piston forces.

The angled axis generate the useful torque in the spherical bearing, which is the only main sliding power transmission part.

The circular motion of the spherical bearing is for the connected L-shaped rod with the pin an ellipse due to the angle between the two axes. Therefore, the pin makes a small stroke motion inside the bore of the spherical bearing to compensate the difference between the rotating radius in a circle and in the ellipse or in the slanted circle respectively.

The piston is sliding on the cylinder quasi force free, because the piston rod is guided by a long sleeve below the piston. An oil ring on top of the sleeve separates the oil flooded housing below from the work chambers above. The piston rings separate the hot work chamber above from the colder chamber below processing the incoming gas and pushing it with high pressure through a bore with an inlet port and an outlet port within the cylinder wall in the primary work chamber above. The work chamber below the piston works basically as a compressor, because there is much less dead volume than by ordinary two stroke engines. (This is the reason the same machine could also work as a "two cylinder" compressor, air engine, steam engine etc with only one piston and cylinder.)

A cut out on the periphery of the piston wall above the piston rings makes it now-due to the rotation of the piston-easy to open and close corresponding ports in the cylinder wall in a sequence similar to a four stroke engine. The transfer port lies now in turning direction after the exhaust port and is open if the exhaust port is already closed. This was a long time desire, but no feasible solution was found.

Every point on the wall of the piston describes (in space an ellipse) on the cylinder wall a path like a sine function. The ports lying in the path of the corresponding cut outs in the piston.

Below the piston is a compressor like work chamber. A great cut out in the wall of the piston controls the inlet port and the lower port of the transfer bore. In axial direction the cut out is about as long as the stroke length to hold closed the inlet port during the transfer phase. There is only a small dead volume (normally it was the entire crank case) that allows the transfer of the gas to the work chamber above the piston at much higher pressure-ergo in much less time. This allows on the end also a higher pressure in the muffler and at the exhaust of the burned gas which means a more silent engine.

Since the work chamber below the piston is already a compressor this machine can easily be modified to a complete compressor, air or steam engine. In this case both ends of the piston are shaped as the lower part having the same control edges on both ends. Both work chambers work independently as compressors. The inlet will be always controlled by the wall (skirt) of the piston. The outlet can be controlled by the piston itself or an ordinary backflow valve.

There is of course also an old fashion solution possible with a short piston without the skirts and valves controlling the gas flow.

For a steam engine or air engine the cut outs in the wall of the piston control both inlet port and outlet port. Both chambers work independently like a two cylinder engine. This steam engine is useable for generating electricity from the heating system of a house, to transform steam energy from small solar heating systems on the roof in mechanical energy, which can be used directly to pump water out of a well—for instance with the Wolfhart Pump or to generate electricity.

This machine has a special kinematic not easily understood. In the centerline of the piston every point of mass makes a linear stroke movement with the corresponding pulsating inertia forces.

In an imaginary cylinder wall with the center of the spherical bearing in it every point of mass runs on an elliptical path like the planets around the sun. They generate no pulsating inertia forces!.

For all the other mass particles between these extremes a mix up of both occurs. They also traveling along an ellipse, but this ellipse is too small. Therefore, low amounts of periodical forces occur rising to 100% of a clean stroke motion in the center. That means for the construction the heavy parts should be placed on the outside—if possible.

DETAILED DESCRIPTION OF THE PREFERRED EMBODIMENTS

Figure 1:
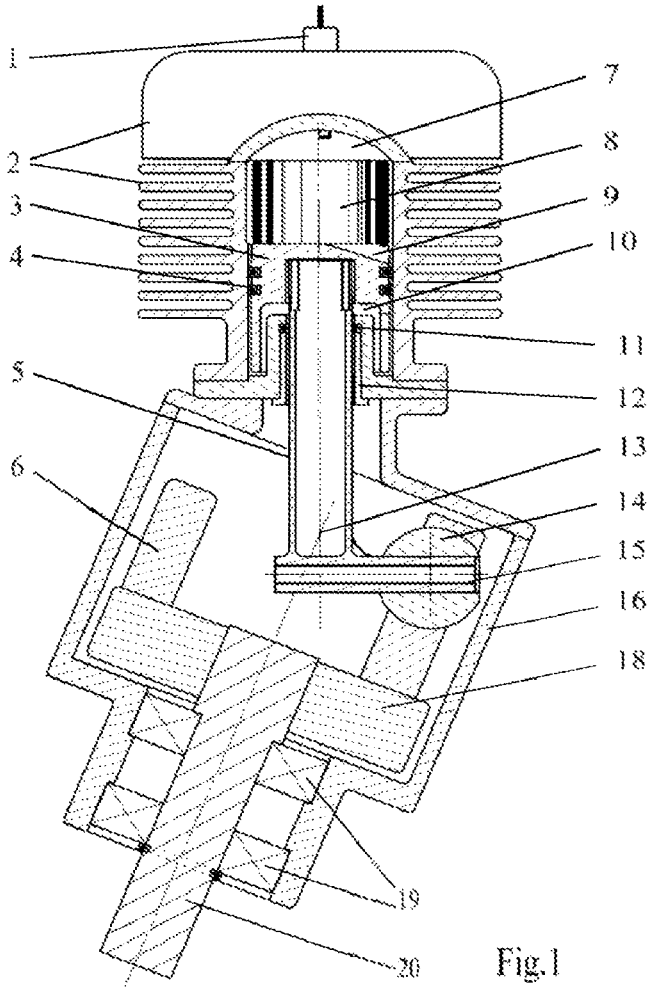
FIG. 1 shows a cross section of a two stroke engine with about 50 cc stroke volume.

Referring now to FIG. 1, there is shown a cross section of a small one cylinder two stroke engine with about 50 cc stroke volume.

The cylinder 8 has on the outside ordinary cooling fans 2 and one inlet port and one exhaust port (ports not shown). The cylinder head has one ordinary spark plug 1.

The piston 3 has on its lower part a long wall (skirt) with a cutout controlling the inlet port in the cylinder and a cut out 9 above the two piston rings controlling the exhaust port and the transfer port.

The piston 3 is also rigidly connected to an L-shaped piston rod 5 like a plunger piston. Therefore the cylinder 8 is closed also on the lower end. This creates besides the work chamber 7 over the piston 3 another work chamber 10 below the piston which is used as a compressor to feed the work chamber 7 with fresh gas.

A sleeve 12 holds the piston rod 5 in the center line that the piston 3 has quasi no friction on the cylinder wall. An oil ring 11 separates the oil flooded housing 16 from the two work chambers in the cylinder 8. Similar to a four stroke engine the leaking oil is enough to lubricate the piston rings 4 if they are not able to run totally dry. There is no need to put any oil in the gasoline any more.

Slanted attached to the cylinder 8 is a housing 16 containing the power transmission parts. A rotating stroke motion of piston 3 and L-shaped piston rod 5 is transformed in a rotating motion of a shaft 20 with only one bearing—a big spherical bearing 14.

To one side the spherical bearing 14 is rigidly connected to a disk 18 connected to a shaft 20 with two bearings 19 taking axial and radial forces.

To the other side the spherical bearing 14 accommodates a pin 15 in its bore. The pin 15 is rigidly connected to the L-shaped piston rod 5 radially on its lower end creating the shape of an "L". The L-shaped piston rod must be very stiff and light as possible. It is a candidate to made in Titanium for high performance engines, but mostly is this engine for movers, edger's, trimmers, chain saws etc.

The spherical bearing 14 rotates only and has a counter weight 6 diametral on the other side of the disk 18.

Both axis from piston 3 and from shaft 20 meet on the intersection point 13 and creating an angle of 22 degrees.

Environmental friendlier is this two stroke engine in different ways:

There is no oil any more in the gasoline.

There is now an unsymmetrical control mechanism as for four stroke engines.

Since the gas transfer is done at higher pressure the muffler can now made much more silent by creating more resistance for the exhaust gas.

Figure 2:
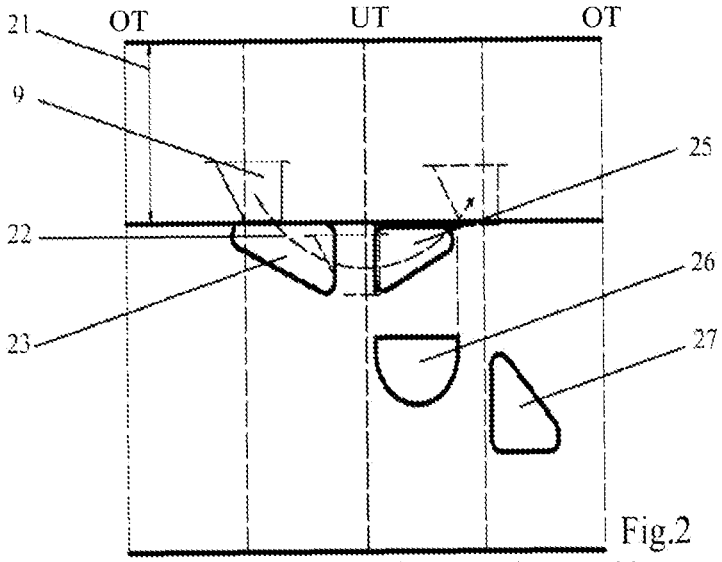
FIG. 2 shows a flat projection of the inner side of a cylinder wall from a two stroke engine

FIG. 2 shows a flat projection of the inner side of a cylinder wall from the two stroke engine from FIG. 1. The locations of the ports are better visible and the gas control mechanism is better understandable. The stroke length 21 is the distance between the upper dead point OT and the lower dead point UT. In this projection every point of the piston wall running along a sine function-like path 22 on the cylinder wall. Near the lower dead point UT three positions of the cut out 9 on the piston 3 are seen. It is clearly recognizable that the cut out 9 first opens the exhaust port 23 and closes it again. Then will it open the transfer port 25. (A little overlapping as by four stroke engines is allowable.)

Figure 3:
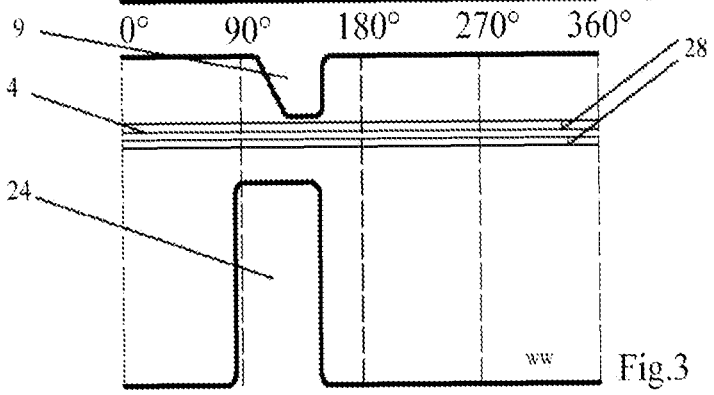
FIG. 3 shows a flat projection of the piston wall from a two stroke engine

FIG. 3 shows a flat projection of the piston wall.

Below the piston rings 4 there is a large cut out 24 in the piston wall controlling the inlet port 27, which is almost 180° long open—the same as for a four stroke engine. The transfer bore is under the cylinder wall and has a upper port 25 and a lower port 26, which is open in time of the transfer. (This port could be open all the time, because the transfer of the gas is controlled already by the upper port 25.)

The piston ring joints 28 sliding on the cylinder in a path similar to a sinus line avoiding any ports. To arrest them to the piston a small pin is placed—not directly in the joint as usual, but behind it in a turning direction. In this way the piston rings will be pulled in turning direction—not pushed to prevent unnecessary friction. The pre-tension of the piston rings can also be lowered as usual, because the centrifugal force pushes the piston rings on the cylinder wall improving the sealing performance of the rings.

Figure 4:
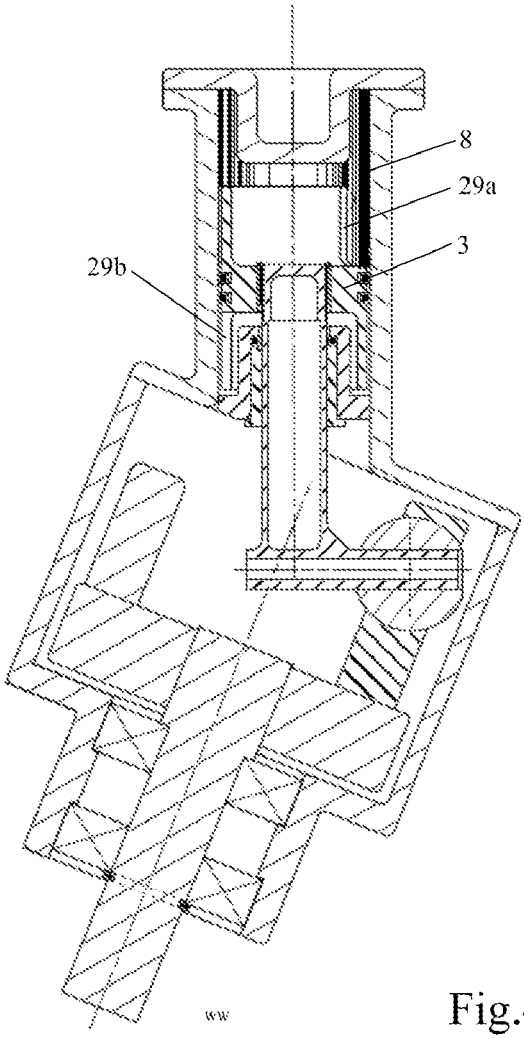
FIG. 4 shows a cross section of a steam engine
Figure 5:
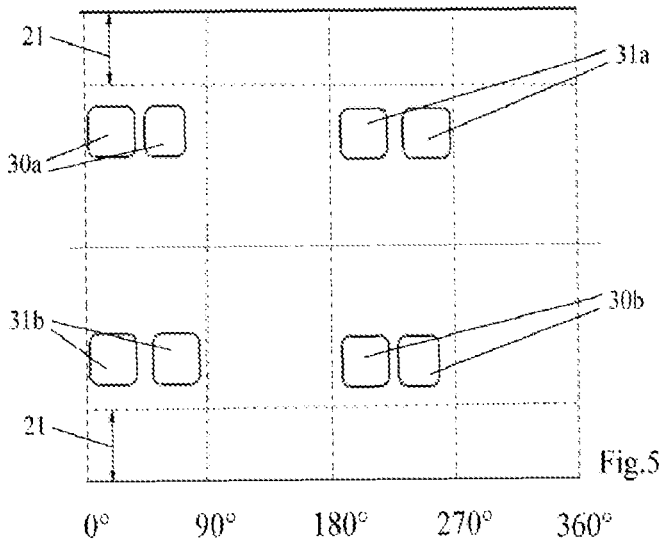
FIG. 5 shows a flat projection of the inner side of a cylinder wall of a steam engine
Figure 6:
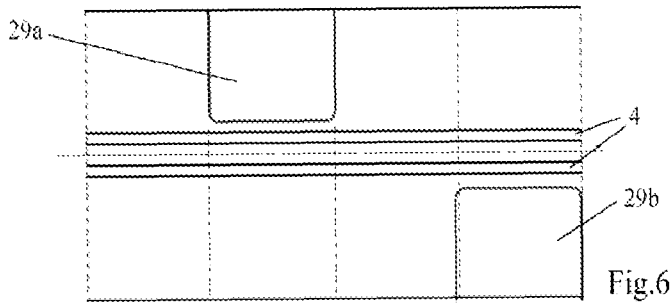
FIG. 6 shows a flat projection of the piston wall of a steam engine

FIG. 4 shows a cross section of a steam engine. It runs basically with any pressurized gas. Everything is the same as in FIG. 1 except the piston 3*a* and cylinder 8*a* are modified. The upper parts and lower parts are now symmetric to each other and like the lower part. The piston 3*a* has now on both sides of the piston rings long walls (skirts) with large cut outs 29*a* and 29*b* as in the flat projections of FIG. 5 and FIG. 6 clearly to see.

The cylinder 8*a* has now two large inlet ports 30*a* and 30*b* and two large outlet ports 31*a* and 31*b*.

Small partition walls in the middle of all large ports are there to support the piston rings, that they not hit the edges of the ports.

Both work chambers both sides of the piston rings work independently. It is like a two cylinder machine with only one piston and cylinder.

The large ports and low friction enables this steam or air engine already to run at low pressures, for instance if the sun is not shining enough to generate enough steam. ("Steam" means not only water vapor.)

It is to be understood that the present invention is not limited to the embodiments described above, but encompasses any and all embodiments within the scope of the following claims.

The invention claimed is:

1. A two-stroke engine, comprising:

a housing having power transmission parts which include an output shaft provided with a central axis, a rigid disk rigidly connected, at its center, to an end of the output shaft for rotation therewith, a spherical bearing rigidly connected eccentrically to the rigid disk and the output shaft via an arm connecting the spherical bearing and the rigid disk;

wherein the spherical bearing further comprising a bore at its center, wherein the housing further comprising bearings for rotatably supporting the output shaft;

a cylinder comprising an upper end and a lower end, wherein the cylinder is further attached to the housing at a predetermined slant angle at the lower end;

wherein the cylinder further comprising transfer ports, an inlet port and an outlet port in a cylinder wall for receiving and discharging a gas, and cooling fins on an outside surface thereof;

a cylindrical piston provided with a central axis, wherein the cylindrical piston further comprises piston rings configured to define two simultaneous working chambers within the cylinder, wherein one of the two working chambers being positioned above the cylindrical piston and the other of the two working chambers being positioned below the cylindrical piston;

wherein the cylindrical piston further comprising, at a lower part thereof, a piston skirt having at least one cutout for controlling the flow of the gas through the inlet port of the cylinder, and at least one cutout above the piston rings for controlling the flow of the gas through the exhaust and transfer ports of the cylinder;

an L-shaped piston rod provided with an axis, an upper end of the piston rod being rigidly connected coaxially to the cylindrical piston to receive piston forces from the cylindrical piston, wherein a lower end of the piston rod comprising a radially directed pin being rigidly attached to the lower end thereof, wherein the pin is further connected within the bore of the spherical bearing in a sliding manner;

wherein the central axis of the output shaft meets the central axis of the piston at an intersection point located at a portion of the L-shaped piston rod, the central axis of the output shaft having the predetermined slant angle with respect to the central axis of the cylindrical piston;

an elongated sleeve rigidly mounted at the lower end of the cylinder;

a cylinder head mounted on the upper end of the cylinder, wherein the cylinder is further closed off at the lower end thereof, wherein the lower end of the cylinder further comprising a hole provided in a center thereof, wherein the elongated sleeve is mounted within the hole and configured to guide the piston rod in a sliding manner with respect to the central axis of the cylindrical piston;

whereby within the cylinder, the cylindrical piston is configured to move in a rotating stroke motion together with the L-shaped piston rod.

2. A steam-air two-stroke engine, comprising:

a housing having power transmission parts which include an output shaft provided with a central axis, a rigid disk rigidly connected, at its center, to an end of the output shaft for rotation therewith, a spherical bearing rigidly connected eccentrically to the rigid disk and the output shaft via an arm connecting the spherical bearing and the rigid disk;

wherein the spherical bearing further comprising a bore at its center, wherein the housing further comprising bearings for rotatably supporting the output shaft;

a cylinder comprising an upper end and a lower end, wherein the cylinder is further attached to the housing at a predetermined slant angle at the lower end;

wherein the cylinder further comprising transfer ports, an inlet port and an outlet port in a cylinder wall for receiving and discharging a gas, and cooling fins on an outside surface thereof;

a cylindrical piston provided with a central axis, wherein the cylindrical piston further comprises piston rings configured to define two simultaneous working chambers within the cylinder, wherein one of the two working chambers being positioned above the cylindrical piston and the other of the two working chambers being positioned below the cylindrical piston;

wherein the cylindrical piston further comprising piston walls provided symmetrically above and below the piston rings, wherein the piston walls further comprising at least one cutout and at least one hole respectively in the walls above and below the piston rings for controlling the flow of the gas through the corresponding ports of the cylinder;

an L-shaped piston rod provided with an axis, an upper end of the piston rod being rigidly connected coaxially to the cylindrical piston to receive piston forces from the cylindrical piston, wherein a lower end of the piston rod comprising a radially directed pin being rigidly attached to the lower end thereof, wherein the pin is further connected within the bore of the spherical bearing in a sliding manner;

wherein the central axis of the output shaft meets the central axis of the cylindrical piston at an intersection point located at a portion of the L-shaped piston rod, the central axis of the output shaft having the predetermined slant angle with respect to the central axis of the cylindrical piston;

an elongated sleeve rigidly mounted at the lower end of the cylinder;

a cylinder head mounted on the upper end of the cylinder, wherein the cylinder is further closed off at the lower end thereof, wherein the lower end of the cylinder further comprising a hole provided in a center thereof, wherein the elongated sleeve is mounted within the hole and configured to guide the piston rod in a sliding manner with respect to the central axis of the cylindrical piston;

whereby within the cylinder, the cylindrical piston is configured to move in a rotating stroke motion together with the L-shaped piston rod.

* * * * *